US006620263B1

(12) United States Patent
Sienkowski

(10) Patent No.: US 6,620,263 B1
(45) Date of Patent: Sep. 16, 2003

(54) ZINC PHOSPHATING PROCESS AND COMPOSITION WITH REDUCED POLLUTION POTENTIAL

(75) Inventor: Michael L. Sienkowski, Warren, MI (US)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 10/129,299

(22) PCT Filed: Nov. 1, 2000

(86) PCT No.: PCT/US00/30118

§ 371 (c)(1),
(2), (4) Date: Sep. 20, 2002

(87) PCT Pub. No.: WO01/32953

PCT Pub. Date: May 10, 2001

Related U.S. Application Data

(60) Provisional application No. 60/163,538, filed on Nov. 4, 1999.

(51) Int. Cl.[7] ..... C23C 22/07

(52) U.S. Cl. ..... 148/262; 148/261; 106/14.12

(58) Field of Search ..... 148/261, 262; 106/14.12

(56) References Cited

U.S. PATENT DOCUMENTS

| | | | |
|---|---|---|---|
| 4,673,444 | A | 6/1987 | Saito et al. |
| 4,762,572 | A | 8/1988 | Mady et al. |
| 4,838,957 | A | 6/1989 | Miyamoto et al. |
| 5,900,073 | A | 5/1999 | Sienkowski et al. |

FOREIGN PATENT DOCUMENTS

| | | |
|---|---|---|
| EP | 0 060 716 | 9/1982 |

*Primary Examiner*—John Sheehan
*Assistant Examiner*—Andrew L. Oltmans
(74) *Attorney, Agent, or Firm*—Stephen D. Harper; Mary K. Cameron

(57) ABSTRACT

The phosphate concentration, and therefore the pollution potential, of conventional high quality phosphating compositions containing zinc, manganese, and, optionally, nickel or copper cations, can be reduced without loss of corrosion protective value of the phosphate coatings formed by maintaining concentrations of active ingredients within prescribed ranges. Under the most preferred conditions, the corrosion resistance of phosphated and then painted cold rolled steel and the paint adhesion to phosphated and then painted electrogalvanized steel are improved over values obtained with the now most commonly used commercial high quality low zinc phosphating processes.

30 Claims, No Drawings

ZINC PHOSPHATING PROCESS AND COMPOSITION WITH REDUCED POLLUTION POTENTIAL

This application is the U.S. National Phase application of and claims priority from International Application Number PCT/US00/30118, filed Nov. 1, 2000, which was published under PCT Article 21(2) in English. This application also claims priority from U.S. provisional application Ser. No. 60/163,538, filed Nov. 4, 1999, which priority was also claimed in said International Application.

BACKGROUND OF THE INVENTION

Field of the Invention

This invention relates to a process for forming a zinc-containing phosphate conversion coating layer on an active metal surface, more particularly a surface selected from the group consisting of (i) steel and other non-passivating ferrous alloys that contain at least 50% by weight of iron, (ii) galvanized steel, (iii) other surfaces of zinc or its alloys that contain at least 50% by weight of zinc; and (iv) aluminum and its alloys containing at least 50% by weight of aluminum.

It is well known that zinc phosphate conversion coatings, particularly those of the modem "low zinc" type, are capable of producing excellent corrosion-protective under-coatings for subsequent painting. It has been generally regarded in the prior art that two of the important characteristics of a "low zinc" phosphating liquid composition are a phosphate concentration of at least 5 grams per liter of composition, this unit of concentration being hereinafter usually abbreviated as "g/l", more preferably at least 10 g/l, and a weight ratio of phosphate to zinc concentrations that is at least 10:1. Processes that use such phosphating compositions produce a substantial volume of effluent water containing phosphate, which in most jurisdictions is a pollutant that must be abated. An object of this invention is to provide phosphating processes that utilize compositions with lower contents of pollutants but still achieve satisfactory corrosion resistance as undercoats for paint.

Except in the claims and the operating examples, or where otherwise expressly indicated to the contrary, all numerical quantities in this description indicating amounts of material or conditions of reaction and/or use are to be understood as modified by the word "about" in describing the broadest scope of the invention. Practice within the numerical limits stated is generally preferred, however. Also, throughout the description and claims, unless expressly stated to the contrary: percent, "parts of", and ratio values are by weight; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; specification of materials in ionic form implies the presence of sufficient counterions to produce electrical neutrality for the composition as a whole, and any counterions thus implicitly specified preferably are selected from among other constituents explicitly specified in ionic form, to the extent possible; otherwise such counterions may be freely selected, except for avoiding counterions that act adversely to the objects of the invention; the term "paint" and its grammatical variations includes any more specialized types of protective exterior coatings that are also known as, for example, lacquer, electropaint, shellac, top coat, base coat, color coat, and the like; and the term "mole" and its variations may be applied to ionic, chemically unstable neutral, or any other chemical species, whether actual or hypothetical, that is specified by the type(s) of atoms present and the number of each type of atom included in the unit defined, as well as to substances with well defined neutral molecules.

BRIEF SUMMARY OF THE INVENTION

It has been found that with proper control of other characteristics of the phosphating composition and process, fully satisfactory underpaint corrosion resistance can be obtained from conversion coatings formed by a phosphating composition with smaller concentrations of phosphate and ratios of phosphate to zinc than has heretofore been taught. The pollution potential of the phosphating compositions is correspondingly reduced. On some substrates, the corrosion resistance is actually improved over that obtained with current conventional processes using otherwise similar phosphating compositions with higher concentrations of phosphate

DETAILED DESCRIPTION OF THE INVENTION AND PREFERRED EMBODIMENTS

A working phosphating composition according to the invention comprises, preferably consists essentially of, or more preferably consists of water and the following components:

(A) a component of dissolved phosphate anions that have a concentration in the working composition that is not more than, with increasing preference in the order given, 13, 10, 9.5, 9.0, 8.5, 8.0, 7.5, 7.0, 6.5, and at least for economy still more preferably is not more than 6.0, 5.5, 5.0, 4.5, 4.0, 3.5, 3.0, or 2.5 g/l and independently preferably is at least, with increasing preference in the order given, 0.5, 1.0, 1.5, 1.7, 1.9, or 2.0 g/l;

(B) a component of dissolved zinc cations that have a concentration in the working composition that is at least, with increasing preference in the order given, 0.30, 0.40, 0.50, 0.60, 0.70, 0.75, 0.80, 0.85, 0.90, 0.93, 0.95, or 0.97 g/l and independently preferably is not more than, with increasing preference in the order given, 2.0,1.8, 1.6, 1.50, 1.40, 1.35, 1.30, 1.25, 1.20, 1.15, 1.10, 1.05, or 1.00 g/l; and (C) a component of dissolved manganese(II) cations that have a concentration in the working composition that is at least, with increasing preference in the order given, 0.05, 0.10, 0.15, 0.20, 0.25, 0.30, 0.35, 0.40, 0.45, or 0.48 and independently preferably is not more than, with increasing preference in the order given, 2.0, 1.5, 1.2, 1.0, 0.90, 0.80, 0.75, 0.70, 0.65, 0.60, 0.55, or 0.50;

and, optionally, one or more of the following components:

(D) a component of at least one of:

dissolved nickel(II) cations that have a concentration in the working composition that is at least, with increasing preference in the order given, 0.10, 0.20, 0.30, 0.40, 0.50, or 0.60 g/l and independently preferably is not more than, with increasing preference in the order given, 2.0,1.5,1.3, or 1.1 g/l; and dissolved copper cations that have a concentration that is at least, with increasing preference in the order given, 0.0001, 0.0003, 0.0005, 0.0007, 0.0009, 0.0011, 0.0013, 0.0015, 0.0017, 0.0019, or 0.0021 g/l and independently preferably is not more than, with increasing preference in the order given, 0.030, 0.025, 0.020, 0.015, 0.010, or 0.070 g/l;

(E) a component of dissolved fluorine-containing anions that have a stoichiometric equivalent as fluoride that is at least, with increasing preference in the order given, 0.05, 0.10, 0.15, 0.20, 0.25, 0.30, 0.35, 0.40, 0.45, 0.50, or 0.55 g/l and independently preferably is not more than, with increasing preference in the order given, 2.0, 1.5, 1.2, 1.0, 0.90, or 0.80 g/l;

(F) a component of dissolved nitrate ions that have a concentration in the working composition that is at least, with increasing preference in the order given, 0.5, 1.0, 1.5, 2.0, 2.5, 3.0, 3.5, or 3.9 g/l and independently, at least for economy, preferably is not more than, with increasing preference in the order given, 20, 15, 12, 10, or 8.8 g/l; and (G) a dissolved accelerator component consisting of at least one substance selected from the group consisting of:

0.3 to 4 g/l of chlorate ions;

0.01 to 0.2 g/l of nitrite ions;

0.05 to 2 g/l of m-nitrobenzene sulphonate ions;

0.05 to 2 g/l of m-nitrobenzoate ions;

0.05 to 2 g/l of p-nitrophenol;

0.005 to 0.15 g/l of hydrogen peroxide in free or bound form;

0.1 to 10 g/l of hydroxylamine in free or bound form; and 0.1 to 10 g/l of reducing sugar.

If the composition has an initial pH value lower than 3.80+0.03, it has positive Free Acid points which are quantitatively defined as equal to the number of milliliters (hereinafter usually abbreviated as "ml") of 0.100 N strong alkali required to titrate a 10.0 ml sample of the composition to a pH value of 3.80±0.03; if the initial value of pH of the composition is higher than 3.80±0.03, it has negative Free Acid points, which are defined as the negative number with the same absolute value as the number of ml of strong acid required to titrate a 10 ml sample of the composition to a pH of 3.80+0.03. If the initial composition has a pH of 3.80±0.03, it has 0.0 points of Free Acid. In addition to containing the above-noted components, a working composition according to the invention preferably has a Free Acid value that is at least, with increasing preference in the order given, −1.0, −0.5, 0.0, 0.10, 0.20, 0.30, 0.40, or 0.49 points and independently preferably is not more than, with increasing preference in the order given, 3.0, 2.5, 2.0, 1.90, 1.80, 1.70, 1.60, 1.50, 1.40, 1.30, 1.20, or 1.11 points.

The presence of nickel cations in a composition according to the invention is preferred, unless the anti-pollution laws in the jurisdiction where the composition is used make the presence of nickel impractical economically. In such an instance, the presence of copper cations is alternatively preferred, unless they too are economically impractical because of pollution.

The presence of fluoride containing anions in a composition according to the invention is generally preferred, especially when phosphating aluminum under most conditions. When phosphating steel or zinciferous surfaces such as galvanized steel, all of the fluoride present is preferably complex fluoride, but when phosphating aluminum, some of the fluoride is preferably present as "free fluoride", a characteristic of the composition that can be measured by a fluoride ion sensitive electrode in contact with the composition and electrically connected to a reference electrode also in the same volume of composition, as known to those skilled in the art. Complex fluoride is preferably supplied to a composition according to the invention by at least one of tetrafluoroboric acid, hexafluorosilicic acid, hexafluorotitanic acid, hexafluorozirconic acid, and salts of all of these acids. At least for economy, hexafluorosilicic acid is most preferred. When free fluoride is needed or desired, it is preferably supplied by hydrofluoric acid and/or ammonium hydrogen fluoride.

The presence of nitrate in a composition according to the invention is preferred, and independently the nitrate is preferably provided at least in part by nitric acid, although nitrate salts may also be used. When nitrate is used, it preferably is present in a ratio to phosphate that is at least, with increasing preference in the order given, 0.20:1.00, 0.25:1.00, 0.30:1.00, 0.37:1.00, 0.39:1.00, 0.41:1.00, 0.80:1.00, 1.2:1.00, 1.6:1.00, or 1.9:1.00 and independently, at least for economy, preferably is not more than, with increasing preference in the order given, 30:1.00, 20:1.00, 10:1.00, 5:1.00, 3.0:1.00, 2.5:1.00, 2.2:1.00, or 2.0:1.00. The major identified reason for a preference for the presence of nitrate in at least the above ratios to phosphate is an improved resistance to corrosion after painting in such tests as GM 9540P, particularly on cold rolled steel.

If only zinciferous surfaces are to be phosphated, an accelerator component is not needed in a composition according to the invention, but for predominantly ferriferous and/or aluminiferous surfaces an accelerator is preferred. If there is no objection from an operator of a phosphating process to monitoring the concentration of accelerator and replenishing it as needed from a source that is distinct from the source of other replenishing ingredients, nitrite is generally preferred as the accelerator, because of its high technical reliability and effectiveness at a low concentration. When nitrite is used as the accelerator, its concentration preferably is at least, with increasing preference in the order given, 0.03, 0.05, 0.07, 0.09, or 0.11 g/l and independently preferably is not more than 0.18, 0.16, 0.14, or 0.12 g/l. If nitrite is considered hazardous because of the possibility of generation of nitrous oxides or other noxious materials from its misuse, similar advantages may be obtained by the use of hydrogen peroxide. (Because both nitrite and hydrogen peroxide are subject to fairly rapid decomposition in acid solutions, they preferably are not added to a phosphating composition until shortly before it begins to be used and therefore preferably are not included in make-up or replenisher concentrates.)

If the convenience of a single package replenisher is preferred, hydroxylamine in one of its stable bound forms is preferred as the accelerator. Salts of hydroxylamine with any strong acid are generally stable enough in compositions according to the invention to be practically included in single package concentrates, with the sulfate being particularly preferred at least for economy. Oximes can also serve as a suitable source of hydroxylamine. Irrespective of the specific source, when hydroxylamine is used as the accelerator in a working composition according to this invention, the concentration, measured as its stoichiometric equivalent as hydroxylamine, preferably is at least, with increasing preference in the order given, 0.20, 0.25, 0.30, 0.33, 0.36, or 0.39 g/l and independently preferably is not more than, with increasing preference in the order given, 1.5, 1.0, 0.90, 0.80, 0.85, 0.80, 0.75, 0.70, 0.65, or 0.61 g/l.

A phosphating process according to the invention can be accomplished by contacting a suitably prepared substrate with a composition according to the invention. Any method of achieving contact may be used, with one of immersion and spraying generally being preferred, depending on the size and the complexity of the shape of the surface to be phosphated, as generally known in the art. Consistent phosphating results are generally obtained when, and it is therefore preferred that, the temperature of the phosphating composition is controlled while it is in contact with the surface being phosphated. This temperature preferably is at least, with increasing preference in the order given, 30, 35, 37, 39, 41, or 43° C. and independently, primarily for economy, preferably is not more than, with increasing preference in the order given, 85, 75, 70, 65, 63, 61, 59, 57, or 55° C.

The mass of the phosphate coating formed can be determined by methods known in the art. This characteristic of a process according to the invention is generally reported as "coating weight", which is defined as the mass of the coating in grams divided by the surface area of the coating in square meters (hereinafter usually abbreviated as "$g/m^2$"). For predominantly ferriferous surfaces such as cold rolled steel, the coating weight preferably is at least, with increasing preference in the order given, 0.50, 0.60, 0.70, 0.80, or 0.86 $g/m^2$ and independently preferably is not more than, with increasing preference in the order given, 5.0, 4.5, 4.0, 3.5, 3.3, 3.0, 2.8, or 2.6 $g/m^2$. For predominantly zinciferous surfaces such as all types of galvanized steel, the coating weight preferably is at least, with increasing preference in the order given, 0.50, 0.60, 0.70, 0.80, 0.90, 1.00, or 1.10 $g/m^2$ and independently preferably is not more than, with increasing preference in the order given, 7.0, 6.5, 6.0, 5.5, 5.0, 4.5, 4.1, or 3.8 $g/m^2$. For predominantly aluminiferous surfaces such as commercial aluminum alloys, the coating weight preferably is at least, with increasing preference in the order given, 0.50, 0.60, 0.70, 0.80, 0.90, 1.00, or 1.05 $g/m^2$ and independently preferably is not more than, with increasing preference in the order given, 5.5, 5.0, 4.5, 4.0, 3.5, 3.0, 2.8, 2.6, 2.4, or 2.2 $g/m^2$. (All of these coating weight preferences are based on corrosion test results and may need to be changed in special circumstances.)

The time of contact between the phosphating composition and the substrate in a process according to the invention is generally not at all critical if the desired coating weight is achieved, presumably because the rate of formation of the coating is much faster at the beginning of contact of a fresh metal surface with a phosphating composition than after even a thin phosphate coating has initially formed. As a general guideline, when contact is by immersion, the contact time preferably is at least, with increasing preference in the order given, 0.2, 0.5, 0.7, 0.9, 1.1, 1.3, 1.5, 1.7, or 1.9 minutes and independently preferably is not more than, with increasing preference in the order given, 30, 20, 15, 10, 5, 3.0, 2.7, 2.5, 2.3, or 2.1 minutes; and when contact is by spraying, the contact time preferably is at least, with increasing preference in the order given, 0.05, 0.10, 0.20, 0.30, 0.40, 0.50, 0.60, 0.70, 0.80, 0.90, or 0.95 minutes and independently preferably is not more than, with increasing preference in the order given, 10, 7, 5, 4.0, 3.5, 3.0, 2.5, or 2.1 minutes.

Before being contacted with a composition according to the invention, a substrate to be phosphated in a process according to the invention is preferably cleaned, rinsed, and activated by any of the means known for these purposes in the art. Some preferred, but by no means exclusive, embodiments are illustrated in the examples below. Similarly, after the desired time of contact between a phosphating composition according to the invention and a substrate has been completed, the substrate is preferably removed from contact with any phosphating composition, rinsed with water, and optionally further treated as known in the art and illustrated in the examples below.

This invention and its benefits may be further appreciated by consideration of the examples and comparison examples given below.

GENERAL PROCESS SEQUENCE FOR THE EXAMPLES AND COMPARISON EXAMPLES

The following operations were performed in the following order (all of the materials identified by trademark below are commercially available from Henkel Surface Technologies Division of Henkel Corporation, Madison Heights, Mich., U.S.A.; this source is hereinafter usually abbreviated as "HST"):

1. Clean by spraying for 90 seconds (hereinafter usually abbreviated as "sec") with a solution made by dissolving in water 0.7% by volume of PARCO® Cleaner Concentrate 1523A and 0.13% by volume of PARCO® Cleaner Concentrate 1523S, this solution being maintained at a temperature of 49° C. in the reservoir for the spray nozzles.
2. Rinse with sprayed tap water for 30 sec, the tap water being maintained at a temperature within a range of 32–35° C. in the reservoir for the spray nozzles.
3. Condition the surface by spraying it for 30 sec with a solution made by dissolving in water 1.5 g/l of FIXODINE® Z8 Conditioner Concentrate, this solution being maintained at a temperature within a range of 24–27° C. in the reservoir for the spray nozzles.
4. Phosphate coat as described in more detail below.
5. Spray rinse with tap water for 30 sec at ambient human comfort temperature (18–23° C.).
6. Spray rinse with deionized water for 30 sec at ambient human comfort temperature.
7. Dry by blowing with compressed air at ambient human comfort temperature.

In some instances, as indicated in specific comments below, the test specimens were further coated with paint or other protective coatings before certain types of corrosion resistance testing.

Substrates

All of the substrates tested were conventional rectangular test panels of one of the following materials: cold rolled steel, electrogalvanized steel, hot dip galvanized steel; Electrogalvaneal™, and Aluminum Alloys 2036, 5052, and 6111.

Working Compositions and Processes

Some details of working compositions and process conditions are shown in Table 1. In addition to the ingredients listed in Table 1, each composition contained about 0.11 g/l of nitrite ions, supplied as sodium nitrite. In Examples 1 through 30 and Comparison Example 1, the substrates were contacted by immersion for 2.0 minutes, and in Example 31 the substrates were contacted by spray for 1.0 minutes. In Examples 1–30 and Comparison Example 1, all of the fluoride shown in Table 1 was added as $H_2SiF_6$. In Example 31, 0.6 g/l of the fluoride shown was added as $H_2SiF_6$ and the remainder as HF. In Table 1, "Ex" means "Example" (according to the invention) and "CE" means "Comparison Example".

Table 2 shows the tested properties of the coatings resulting from all of the compositions in Table 2 except for Example 15, which was a duplicate of Example 3, and Example 30; tested properties for Example 30 and modifications of it are shown in Table 3, where the designation "With Free Fluoride" means that, in addition to the amounts of complex fluoride indicated in Table 1, sufficient HF was added to the composition shown as Example 30 in Table 1 to result in a reading of 150 microamps on a LINE-GUARD® 101A Meter (available commercially from HST). Some results of accelerated corrosion testing are shown in Tables 4 and 5.

Table 4 shows corrosion test results for all compositions and process conditions in Table 2 on cold rolled steel and electrogalvanized steel substrates. Before beginning the testing reported in Table 4, the substrates were further coated as follows after standard operations 1–6 as described above: Electropaint cathodically with PPG ED5050B primer (for all except Example 31) or BASF U 32AD350 "lead-free" primer (for Example 31)—Base coat with DuPont bright white 527DF715 —Top (clear) coat with DuPont RK8010.

Table 5 shows corrosion test results for some of the variations of the composition of Example 30 as shown in Table 3. To produce the results shown In Table 5, substrates phosphated with coating weights and surface appearances as shown in Table 3 "with free fluoride" were used when the electropaint primer used did not contain lead, and substrates phosphated with a coating weight and surface appearance as shown in Table 3 "without free fluoride" were used when the electropaint primer did contain lead. Before beginning these corrosion tests, the substrates were further prepared in the same manner as for Table 4, except as follows: When Table 5 indicates "PLN 90 post-treatment", a solution of PARCOLENE® 90 post-treatment concentrate (from HST), prepared as recommended by the supplier, was used instead of deionized water in Operation 6 as described above; when Table 5 indicates "Pb-free", the substrates were painted as for Example 31 of Table 4; and when Table 5 indicates "Pb-containing E-coat", the substrates, after being post-treated (with water or the solution of PARCOLENE®90), were painted as for Examples 1–29 of Table 4. Also, in Table 5, results of three or two intended replicate test panels are reported separately. In addition to the results reported in Table 5, paint adhesion on cold rolled steel and electrogalvanized steel substrates before and after 240 hours of water soak was measured and showed no loss of adhesion whatever.

These results indicate that the present invention, at least in its more preferred embodiments, confers at least as much corrosion protection on the substrates tested as does current, commercially established zinc, manganese, and nickel "tri-cation" phosphating processes. It is particularly noteworthy that the corrosion resistance of phosphated and painted cold rolled steel improves, and the sensitivity of this corrosion resistance to the Free Acid value of the phosphating composition decreases, as the phosphate concentration is lowered within the preferred values for this invention. The lower phosphate values also promote better paint adhesion test ratings on electrogalvanized steel after water soak.

TABLE 1

| | Amount in Corresponding Composition of: | | | | | | | |
|---|---|---|---|---|---|---|---|---|
| Identifier | $PO_4^{-3}$, g/l | $Zn^{+2}$, g/l | $Mn^{+2}$, g/l | $Ni^{+2}$, g/l | Anionic F, g/l | $NO_3^-$, g/l | FA Points | Temperature, ° C. |
| Ex 1 | 3.1 | 0.98 | 0.49 | 0.10 | 0.53 | 3.9 | 0.5 | 54 |
| Ex 2 | 3.1 | 0.98 | 0.49 | 0.10 | 0.53 | 3.9 | 1.1 | 43 |
| Ex 3 | 9.3 | 0.98 | 0.49 | 0.10 | 0.53 | 3.9 | 0.5 | 43 |
| Ex 4 | 9.3 | 0.98 | 0.49 | 0.10 | 0.53 | 3.9 | 1.1 | 54 |
| Ex 5 | 3.1 | 0.98 | 0.49 | 1.10 | 0.53 | 3.9 | 0.5 | 43 |
| Ex 6 | 3.1 | 0.98 | 0.49 | 1.10 | 0.53 | 3.9 | 1.1 | 54 |
| Ex 7 | 9.3 | 0.98 | 0.49 | 1.10 | 0.53 | 3.9 | 0.5 | 54 |
| Ex 8 | 9.3 | 0.98 | 0.49 | 1.10 | 0.53 | 3.9 | 1.1 | 43 |
| Ex 9 | 3.1 | 0.98 | 0.49 | 0.10 | 0.53 | 8.7 | 0.5 | 43 |
| Ex 10 | 3.1 | 0.98 | 0.49 | 0.10 | 0.53 | 8.7 | 1.1 | 54 |
| Ex 11 | 9.3 | 0.98 | 0.49 | 0.10 | 0.53 | 8.7 | 0.5 | 54 |
| Ex 12 | 9.3 | 0.98 | 0.49 | 0.10 | 0.53 | 8.7 | 1.1 | 43 |
| Ex 13 | 3.1 | 0.98 | 0.49 | 1.10 | 0.53 | 8.7 | 0.5 | 54 |
| Ex 14 | 3.1 | 0.98 | 0.49 | 1.10 | 0.53 | 8.7 | 1.1 | 43 |
| Ex 15 | 9.3 | 0.98 | 0.49 | 1.10 | 0.53 | 8.7 | 0.5 | 43 |
| Ex 16 | 12.2 | 0.98 | 0.49 | 1.10 | 0.53 | 8.7 | 1.1 | 54 |
| Ex 17 | 6.2 | 0.98 | 0.49 | 0.60 | 0.53 | 6.3 | 0.5 | 49 |
| Ex 18 | 6.2 | 0.98 | 0.49 | 0.60 | 0.53 | 6.3 | 1.1 | 49 |
| Ex 19 | 3.1 | 0.98 | 0.49 | 0.60 | 0.53 | 6.3 | 0.8 | 49 |
| Ex 20 | 9.3 | 0.98 | 0.49 | 0.60 | 0.53 | 6.3 | 0.8 | 49 |
| Ex 21 | 6.2 | 0.98 | 0.49 | 0.10 | 0.53 | 6.3 | 0.8 | 49 |
| Ex 22 | 6.2 | 0.98 | 0.49 | 1.10 | 0.53 | 6.3 | 0.8 | 49 |
| Ex 23 | 6.2 | 0.98 | 0.49 | 0.60 | 0.53 | 3.9 | 0.8 | 49 |
| Ex 24 | 6.2 | 0.98 | 0.49 | 0.60 | 0.53 | 8.7 | 0.8 | 49 |
| Ex 25 | 6.2 | 0.98 | 0.49 | 0.60 | 0.53 | 6.3 | 0.8 | 43 |
| Ex 26 | 6.2 | 0.98 | 0.49 | 0.60 | 0.53 | 6.3 | 0.8 | 54 |
| Ex 27 | 6.2 | 0.98 | 0.49 | 0.60 | 0.53 | 6.3 | 0.8 | 49 |
| Ex 28 | 6.2 | 0.98 | 0.49 | 0.60 | 0.53 | 6.3 | 0.8 | 49 |
| Ex 29 | 6.2 | 0.98 | 0.49 | 0.60 | 0.53 | 6.3 | 0.8 | 49 |
| CE 1 | 15.0 | 1.10 | 0.83 | 0.93 | 0.77 | 3.2 | 0.8 | 49 |
| Ex 30 | 2.0 | 0.90 | 0.40 | 0.40 | 0.50 | 4.4 | 0.8 | 49 |
| Ex 31 | 5.3 | 1.20 | 0.39 | 0.62 | 1.20 | 6.5 | 0.8 | 49 |

TABLE 2

| | Coating Characteristics | | | | | |
|---|---|---|---|---|---|---|
| | On Cold Rolled Steel | | | On Electrogalvanized Steel | | |
| Identifier | Coating Weight, g/m$^2$ | Crystal Size, Micrometers | Visual Rating | Coating Weight, g/m$^2$ | Crystal Size, Micrometers | Visual Rating |
| Ex 1 | 2.5 | 2 to 6 | G, D C-A C | 2.15 | 2 to 6 | G, D A C |
| Ex 2 | 0.88 | 2 to 8 | G, D C-A C | 1.65 | 2 to 6 | G, D A C |
| Ex 3 | 2.6 | 2 to 8 | G, D C-A C | 1.80 | 2 to 6 | G, D A C |
| Ex 4 | 1.54 | 2 to 6 | G, D N-A C | 1.48 | 2 to 6 | G, D A C |
| Ex 5 | 1.77 | 2 to 6 | G, D C-A C | 2.39 | 2 to 6 | G, D A C |
| Ex 6 | 1.32 | 2 to 8 | G, D C-A C | 1.18 | 2 to 6 | G, D A C |
| Ex 7 | 2.2 | 1 to 4 | G, D N C | 3.6 | 2 to 6 | G, D A C |
| Ex 8 | 0.99 | 3 to 12 | C-A C w V | 1.55 | 2 to 6 | G, D A C |
| Ex 9 | 2.2 | 2 to 6 | G, D C-A C | 2.18 | 2 to 6 | G, D A C |
| Ex 10 | 1.48 | 2 to 6 | G, D C-A C | 1.91 | 2 to 6 | G, D A C |
| Ex 11 | 2.3 | 1 to 4 | G, D N C | 1.93 | 2 to 6 | G, D A C |
| Ex 12 | 1.34 | 5 to 15 | C-A C w V | 1.61 | 2 to 8 | G, D A C |
| Ex 13 | 2.1 | 2 to 6 | G, D C-A C | 2.8 | 2 to 8 | G, D A C |
| Ex 14 | 1.12 | 2 to 8 | G, D C-A C | 2.3 | 2 to 6 | G, D A C |
| Ex 16 | 1.80 | 2 to 6 | G, D N-A C | 2.1 | 2 to 6 | G, D A C |
| Ex 17 | 1.91 | 1 to 4 | G, D N-A C | 2.35 | 2 to 6 | G, D A C |
| Ex 18 | 1.39 | 2 to 8 | G, D N-A C | 1.64 | 2 to 6 | G, D A C |
| Ex 19 | 1.65 | 2 to 6 | G, D C-A C | 2.03 | 2 to 6 | G, D A C |
| Ex 20 | 1.97 | 2 to 6 | G, D N-A C | 2.14 | 2 to 6 | G, D A C |
| Ex 21 | 1.66 | 2 to 6 | G, D C-A C | 1.73 | 2 to 6 | G, D A C |
| Ex 22 | 1.73 | 2 to 8 | G, D C-A C | 2.2 | 2 to 6 | G, D A C |
| Ex 23 | 1.73 | 2 to 6 | G, D N-A C | 2.05 | 2 to 6 | G, D A C |
| Ex 24 | 1.82 | 2 to 6 | G, D N-A C | 2.0 | 2 to 6 | G, D A C |
| Ex 25 | 1.32 | 2 to 6 | G, D N-A C | 1.95 | 2 to 6 | G, D A C |
| Ex 26 | 1.97 | 1 to 4 | G, D N-A C | 2.36 | 2 to 6 | G, D A C |
| Ex 27 | 1.80 | 2 to 6 | G, D N-A C | 2.10 | 2 to 6 | G, D A C |
| Ex 28 | 1.56 | 2 to 6 | G, D N-A C | 2.14 | 2 to 6 | G, D A C |
| Ex 29 | 1.75 | 2 to 6 | G, D N-A C | 1.94 | 2 to 6 | G, D A C |
| CE 1 | 2.47 | 2 to 6 | G, D N-A C | 3.8 | 2 to 6 | G, D A C |
| Ex 31 | 1.77 | 3 to 8 | G, D A C | 2.6 | 2 to 6 | G, D A C |

New Abbreviations for Table 2
"G, D C-A C" means "Good, dense columnar-acicular crystals";
"G, D A C" means "Good, dense acicular crystals";
"G, D N-A C" means "Good, dense nodular-acicular crystals";
"G, D N C" means "Good, dense nodular crystals"; and
"C-A C w V" means "Columnar-acicular crystals with voids".

New Abbreviations for Table 2

"G, D C-A C" means "Good, dense columnar-acicular crystals"; "G, D A C" means "Good, dense acicular crystals"; "G, D N-A C" means "Good, dense nodular-acicular crystals"; "G, D N C" means "Good, dense nodular crystals"; and "C-A C w V" means "Columnar-acicular crystals with voids".

TABLE 3

| | For Coating by Immersion | | For Coating by Spray: | |
|---|---|---|---|---|
| Substrate Coated | Coating Weight, g/m$^2$ | Visual Rating | Coating Weight, g/m$^2$ | Visual Rating |
| RESULTS WITHOUT ACTIVE FLUORIDE ADDED | | | | |
| CRS | 1.28 | UMGCC | 0.90 | UMGCC |
| EGS | 1.90 | UMGCC | 1.38 | UMGCC |
| HDG | 1.57 | UMGCC | 1.22 | UMGCC |
| EGA | 1.76 | UMGCC | 1.08 | UMGCC |
| RESULTS WITH ACTIVE FLUORIDE ADDED | | | | |
| CRS | 1.25 | UMGCC | 0.92 | UMGCC |
| EGS | 2.22 | UMGCC | 2.34 | UMGCC |
| HDG | 2.27 | UMGCC | 2.15 | UMGCC |
| EGA | 1.55 | UMGCC | 2.00 | UMGCC |
| 2036 AA | 1.03 | CCwMDaLGCC | 1.03 | UMGCC |

TABLE 3-continued

| | For Coating by Immersion | | For Coating by Spray: | |
|---|---|---|---|---|
| Substrate Coated | Coating Weight, g/m$^2$ | Visual Rating | Coating Weight, g/m$^2$ | Visual Rating |
| 5052 AA | 1.60 | CCwMDaLGCC | 1.36 | UMGCC |
| 6111 AA | 1.28 | CCwMDaLGCC | 1.13 | UMGCC |

New Abbreviations in Table 3
"CRS" means "Cold rolled steel";
"EGS" means "Electrogalvanized steel";
"HDG" means "Hot-dip galvanized steel";
"EGA" means "Electrogalvaneal ™ galvanized steel";
"AA" means "Aluminum Alloy";
"UMGCC" means "Uniform and matte gray colored coating"; and
"CCwMDaLGCC" means "Completely covered with mixed dark and light gray colored coating."

TABLE 4

| Identifier (from Table | GM 9540P Test, ACAS in mm: | | Adhesion after Water Soak Rating on: | |
|---|---|---|---|---|
| 1 or 2) | CRS | EGS | CRS | EGS |
| Ex 1 | 3.6 | 3.0 | 5 | 4 |

TABLE 4-continued

| Identifier (from Table 1 or 2) | GM 9540P Test, ACAS in mm: CRS | GM 9540P Test, ACAS in mm: EGS | Adhesion after Water Soak Rating on: CRS | Adhesion after Water Soak Rating on: EGS |
|---|---|---|---|---|
| Ex 2 | 3.5 | 2.4 | 5 | 1 |
| Ex 3 | 5.2 | 3.3 | 5 | 2 |
| Ex 4 | 3.1 | 2.1 | 5 | 1.5 |
| Ex 5 | 2.3 | 2.2 | 5 | 3 |
| Ex 6 | 2.5 | 2.5 | 5 | 3.5 |
| Ex 7 | 7.0 | 1.3 | 5 | 3.5 |
| Ex 8 | 5.0 | 2.2 | 5 | 1 |
| Ex 9 | 3.4 | 2.7 | 5 | 4 |
| Ex 10 | 3.3 | 3.1 | 5 | 4.5 |
| Ex 11 | 6.0 | 2.3 | 5 | 1 |
| Ex 12 | 3.5 | 2.7 | 5 | 1 |
| Ex 13 | 3.5 | 1.7 | 5 | 4 |
| Ex 14 | 2.8 | 2.5 | 5 | 3.5 |
| Ex 15 | 6.0 | 2.1 | 5 | 3.5 |
| Ex 16 | 1.9 | 2.1 | 5 | 2 |
| Ex 17 | 3.5 | 2.0 | 5 | 3.5 |
| Ex 18 | 2.0 | 2.5 | 5 | 2 |
| Ex 19 | 2.8 | 1.5 | 5 | 3 |
| Ex 20 | 3.6 | 2.8 | 5 | 2 |
| Ex 21 | 2.5 | 2.7 | 5 | 1 |
| Ex 22 | 3.5 | 1.8 | 5 | 4.5 |
| Ex 23 | 4.9 | 1.3 | 5 | 2.5 |
| Ex 24 | 4.2 | 1.7 | 5 | 4.5 |
| Ex 25 | 2.7 | 1.4 | 5 | 4.5 |
| Ex 26 | 3.6 | 2.0 | 5 | 4 |
| Ex 27 | 3.5 | 1.3 | 5 | 4 |
| Ex 28 | 2.8 | 1.3 | 5 | 4.5 |
| Ex 29 | 4.1 | 1.7 | 5 | 4 |
| CE 1 | 6.7 | 2.1 | 5 | 3.5 |
| Ex 31 | 10.3 | 2.4 | 5 | 5 |

Note:
"ACAS" means "Average creep across scribe".

TABLE 5

| Test and Value Reported | Substrate | Post Treatment | Pb in Electrocoated Primer? | Test Result on Panel Number: 1 | 2 | 3 |
|---|---|---|---|---|---|---|
| GM9540P 40 Cycles Average Creep Across Scribe in Millimeters Reported | CRS | PLN 90 | No | 4.2 | 3.4 | 3.1 |
| | | Deionized water | | 8.9 | 8.8 | 7.3 |
| | EGS | PLN 90 | | 1.8 | 2.4 | 2.5 |
| | | Deionized water | | 2.2 | 1.8 | 2 |
| | HDG | PLN 90 | | 2.7 | 3.1 | 2.6 |
| | | Deionized water | | 2.8 | 3.6 | 3.3 |
| | HDA | PLN 90 | | 1.8 | 1.7 | 1.7 |
| | | Deionized water | | 1.8 | 2.3 | 1.7 |
| | AA 6111 | PLN 90 | | 3.4 | 4.5 | 5.2 |
| | | Deionized water | | 5.8 | 5.3 | 6.7 |
| | CRS | PLN 90 | Yes | 1.5 | 1.6 | N.d. |
| | | Deionized water | | 2.7 | 3 | N.d. |
| | EGS | PLN 90 | | 1.4 | 1.8 | N.d. |
| | | Deionized water | | 1.2 | 1.9 | N.d. |
| 336 Hour Salt Spray, ACAS in mm Reported | CRS | PLN 90 | No | 0.8 | 0.9 | N.d. |
| | | Deionized water | | 0.9 | 0.9 | N.d. |

Note for Table 5:
"N.d." means "not determined".

What is claimed is:

1. An aqueous liquid working composition for forming a phosphate conversion coating on a metal surface by spontaneous chemical reaction upon contact with said metal surface, said aqueous liquid working composition comprising water and the following components:

(A) dissolved phosphate anions that have a concentration in the working composition within a range from about 1.5 g/l to about 4.5 g/l;

(B) dissolved zinc cations that have a concentration in the working composition that is within a range from about 0.60 g/l to about 1.30 g/l;

(C) dissolved manganese(II) cations that have a concentration in the working composition that is within a range from about 0.35 g/l to about 0.55 g/l;

(D) at least one of:

(i) dissolved nickel(II) cations that have a concentration in the working composition within a range from about 0.10 g/l to about 1.5 g/l; and (ii) dissolved copper cations that have a concentration in the working composition that is within a range from about 0.0011 g/l to about 0.025 g/l;

(E) dissolved fluoride-containing anions that have a stoichiometric equivalent as fluoride in the working composition that is within a range from about 0.45 g/l to about 0.80 g/l;

(F) dissolved nitrate ions that have a concentration in the working composition of from about 3.5 g/l to about 8.8 g/l.; and (G) dissolved accelerator consisting of at least one substance, at the specified concentration in the working composition, selected from the group consisting of:

(i) about 0.3 g/l to about 4 g/l of chlorate ions;

(ii) about 0.01 g/l to about 0.2 g/l of nitrite ions;

(iii) about 0.05 g/l to about 2 g/l of m-nitrobenzene sulphonate ions;

(iv) about 0.05 g/l to about 2 g/l of m-nitrobenzoate ions;

(v) about 0.05 g/l to about 2 g/l of p-nitrophenol;

(vi) about 0.005 g/l to about 0.15 g/l of hydrogen peroxide in free or bound form;

(vii) about 0.1 g/l to about 10 g/l of hydroxylamine in free or bound form; and (viii) about 0.1 g/l to about 10 g/l of reducing sugar;

wherein said aqueous liquid working composition has a Free Acid value within a range from about −0.5 points to about 1.20 points.

2. An aqueous liquid working composition according to claim 1 wherein the dissolved phosphate anions (A) concentration is within a range from about 1.5 g/l to about 2.5 g/l.

3. An aqueous liquid working composition according to claim 1 wherein the dissolved zinc cations (B) concentration is within a range from about 0.80 g/l to about 1.20 g/l.

4. An aqueous liquid working composition according to claim 1 wherein the dissolved manganese cations (C) concentration is within a range from about 0.35 g/l to about 0.50 g/l.

5. An aqueous liquid working composition according to claim 1 wherein the dissolved nickel cations (D)(i) concentration is within a range from about 1.5 g/l to about 2.5 g/l.

6. An aqueous liquid working composition according to claim 1 wherein the dissolved fluorine-containing anions (E) concentration is within a range from about 0.50 g/l to about 0.80 g/l.

7. An aqueous liquid working composition according to claim 1 wherein the dissolved nitrate anions (F) concentration is within a range from about 0.39 g/l to about 6.50 g/l.

8. An aqueous liquid working composition according to claim 1 wherein at least one accelerator component (G) is selected from nitrite and hydrogen peroxide.

9. An aqueous liquid working composition according to claim 1 wherein at least one accelerator component (G) is hydroxylamine.

10. An aqueous liquid working composition for forming a phosphate conversion coating on a metal surface by spontaneous chemical reaction upon contact with said metal surface, said aqueous liquid working composition having been made by mixing with water at least the following substances:

(A) a source of dissolved phosphate anions in an amount corresponding to a concentration of dissolved phosphate anions in the working composition within a range from about 1.5 g/l to about 4.5 g/l;

(B) a source of dissolved zinc cations in an amount corresponding to a concentration of dissolved zinc cations in the working composition that is within a range from about 0.60 g/l to about 1.30 g/l;

(C) a source of dissolved manganese(II) cations in an amount corresponding to a concentration of dissolved manganese(II) cations in the working composition that is within a range from about 0.35 g/l to about 0.55 g/l;

(D) a source of at least one of:

(i) dissolved nickel(II) cations in an amount corresponding to a concentration of dissolved nickel(II) cations in the working composition within a range from about 0.10 g/l to about 1.5 g/l; and (ii) dissolved copper cations in an amount corresponding to a concentration of dissolved copper cations in the working composition that is within a range from about 0.0011 g/l to about 0.025 g/l;

(E) a source of dissolved fluorine-containing anions in an amount corresponding to a stoichiometric equivalent as fluoride in the working composition of dissolved fluorine-containing anions that is within a range from about 0.45 g/l to about 0.80 g/l;

(F) a source of dissolved nitrate ions in an amount corresponding to a concentration of dissolved nitrate ions in the working composition of from about 3.5 g/l to about 8.8 g/l; and (G) a source of dissolved accelerator consisting of at least one substance, at the specified concentration of such dissolved ion in the working composition, selected from the group consisting of:

(i) about 0.3 g/l to about 4 g/l of chlorate ions;

(ii) about 0.01 g/l to about 0.2 g/l of nitrite ions;

(iii) about 0.05 g/l to about 2 g/l of m-nitrobenzene sulphonate ions;

(iv) about 0.05 g/l to about 2 g/l of m-nitrobenzoate ions;

(v) about 0.05 g/l to about 2 g/l of p-nitrophenol;

(vi) about 0.005 g/l to about 0.15 g/l of hydrogen peroxide in free or bound form;

(vii) about 0.1 g/l to about 10 g/l of hydroxylamine in free or bound form; and (viii) about 0.1 g/l to about 10 g/l of reducing sugar;

wherein said aqueous liquid working composition has a Free Acid value within a range from about −0.5 points to about 1.20 points.

11. An aqueous liquid working composition according to claim 10 wherein the dissolved phosphate anions (A) concentration is within a range from about 1.5 g/l to about 2.5 g/l.

12. An aqueous liquid working composition according to claim 10 wherein the dissolved zinc cations (B) concentration is within a range from about 0.80 g/l to about 1.20 g/l.

13. An aqueous liquid working composition according to claim 10 wherein the dissolved manganese cations (C) concentration is within a range from about 0.35 g/l to about 50 g/l.

14. An aqueous liquid working composition according to claim 10 wherein the dissolved nickel cations (D)(i) concentration is within a range from about 1.5 g/l to about 2.5 g/l.

15. An aqueous liquid working composition according to claim 10 wherein the dissolved nitrate anions (F) concentration is within a range from about 0.39 g/l to about 6.50 g/l.

16. An aqueous liquid working composition according to claim 15 wherein the dissolved fluorine-containing anions (E) concentration is within a range from about 0.50 g/l to about 0.80 g/l.

17. An aqueous liquid working composition according to claim 10 wherein at least one accelerator component (G) is selected from nitrite and hydrogen peroxide.

18. An aqueous liquid working composition according to claim 10 wherein at least one accelerator component (G) is hydroxylamine.

19. A process of forming a phosphate conversion coating on a metal substrate by contacting said metal substrate with an aqueous liquid composition aqueous liquid working composition having been made by mixing with water at least the following substances:

(A) a source of dissolved phosphate anions in an amount corresponding to a concentration of dissolved phosphate anions in the working composition within a range from about 1.5 g/l to about 4.5 g/l;

(B) a source of dissolved zinc cations in an amount corresponding to a concentration of dissolved zinc cations in the working composition that is within a range from about 0.60 g/l to about 1.30 g/l;

(C) a source of dissolved manganese(II) cations in an amount corresponding to a concentration of dissolved manganese(II) cations in the working composition that is within a range from about 0.35 g/l to about 0.55 g/l (D) a source of at least one of:

(i) dissolved nickel(II) cations in an amount corresponding to a concentration of dissolved nickel(II) cations in the working composition within a range from about 0.10 g/l to about 1.5 g/l; and (ii) dissolved copper cations in an amount corresponding to a concentration of dissolved copper cations in the working composition that is within a range from about 0.0011 g/l to about 0.025 g/l;

(E) a source of dissolved fluorine-containing anions in an amount corresponding to a stoichiometric equivalent as fluoride in the working composition of dissolved fluorine-containing anions that is within a range from about 0.45 g/l to about 0.80 g/l;

(F) a source of dissolved nitrate ions in an amount corresponding to a concentration of dissolved nitrate ions in the working composition of from about 3.5 g/l to about 8.8 g/l; and (G) a source of dissolved accelerator consisting of at least one substance, at the specified concentration of such dissolved ion in the working composition, selected from the group consisting of:

(i) about 0.3 g/l to about 4 g/l of chlorate ions;

(ii) about 0.01 g/l to about 0.2 g/l of nitrite ions;

(iii) about 0.05 g/l to about 2 g/l of m-nitrobenzene sulphonate ions;

(iv) about 0.05 g/l to about 2 g/l of m-nitrobenzoate ions;

(v) about 0.05 g/l to about 2 g/l of p-nitrophenol;

(vi) about 0.005 g/l to about 0.15 g/l of hydrogen peroxide in free or bound form;

(vii) about 0.1 g/l to about 10 g/l of hydroxylamine in free or bound form; and (viii) about 0.1 g/l to about 10 g/l of reducing sugar;

wherein said aqueous liquid working composition has a Free Acid value within a range from about −0.5 points to about 1.20 points.

20. A process according to claim 19 wherein the dissolved phosphate anions (A) concentration is within a range from about 1.5 g/l to about 2.5 g/l.

21. A process according to claim 19 wherein the dissolved zinc cations (B) concentration is within a range from about 0.80 g/l to about 1.20 g/l.

22. A process according to claim 19 wherein the dissolved manganese cations (C) concentration is within a range from about 0.35 g/l to about 50 g/l.

23. A process according to claim 19 wherein the dissolved nickel cations (D)(i) concentration is within a range from about 1.5 g/l to about 2.5 g/l.

24. A process according to claim 19 wherein the dissolved fluorine-containing anions (E) concentration is within a range from about 0.50 g/l to about 0.80 g/l.

25. A process according to claim 19 wherein the dissolved nitrate anions (F) concentration is within a range from about 0.39 g/l to about 6.50 g/l.

26. A process according to claim 19 wherein at least one accelerator component (G) is selected from nitrite and hydrogen peroxide.

27. A process according to claim 19 wherein at least one accelerator component (G) is hydroxylamine.

28. A process according to claim 19 wherein the temperature of said aqueous liquid working composition is maintained within the range from about 35° C. to about 61° C.

29. A process according to claim 19 wherein the substrate has a surface with a predominant content of iron, zinc, or aluminum and the coating weight formed on said surface by the process is within a range from about 0.80 g/ $m^2$to about 2.8 g/$m^2$ if the surface has a predominant content of iron, within a range from about 1.0 g/$m^2$ to about 4.1 g/$m^2$ if the surface has a predominant content of zinc, and within a range from about 1.0 g/$m^2$ to about 2.4 g/$m^2$ if the surface has a predominant content of aluminum.

30. A process according to claim 19 wherein the substrate has a surface with a predominant content of iron, zinc, or aluminum and the coating weight formed on said surface by the process is within a range from about 0.80 g/$m^2$ to about 2.8 g/$m^2$ if the surface has a predominant content of iron, within a range from about 1.0 to about 4.1 g/$m^2$ if the surface has a predominant content of zinc, and within a range from about 1.0 g/$m^2$ to about 2.4 g/$m^2$ if the surface has a predominant content of aluminum.

* * * * *

UNITED STATES PATENT AND TRADEMARK OFFICE

CERTIFICATE OF CORRECTION

PATENT NO. : 6,620,263 B1
DATED : September 16, 2003
INVENTOR(S) : Michael L. Sienkowski It is certified that error appears in the above-identified patent and that said Letters Patent is hereby corrected as shown below:

Column 16,
Line 3, delete "50" and insert -- 0.50 --.

Signed and Sealed this

Thirty-first Day of January, 2006

JON W. DUDAS
*Director of the United States Patent and Trademark Office*